US005529078A

United States Patent [19]

Rehder et al.

[11] Patent Number: 5,529,078

[45] Date of Patent: Jun. 25, 1996

[54] SMOKER'S BOX

[75] Inventors: Miles R. Rehder, Arvada; Richard D. Iwanski, Dacono; Judson R. Meyers, Broomfield; Steven M. Patten, Boulder, all of Colo.

[73] Assignee: Truce, Inc., Broomfield, Colo.

[21] Appl. No.: 239,508

[22] Filed: May 9, 1994

[51] Int. Cl.[6] ..... A24F 1/00

[52] U.S. Cl. ..... 131/175; 131/329; 131/185; 131/206; 131/215.3

[58] Field of Search ..... 131/330, 175, 131/185, 186, 194

[56] References Cited

U.S. PATENT DOCUMENTS

| | | | |
|---|---|---|---|
| 4,066,088 | 1/1978 | Ensor . | |
| 4,083,374 | 4/1978 | Jacobsen . | |
| 4,200,114 | 4/1980 | Waite . | |
| 4,369,798 | 1/1983 | Jackson . | |
| 4,790,332 | 12/1988 | Wallace . | |
| 4,807,646 | 2/1989 | Sahar . | |
| 4,899,766 | 2/1990 | Ross, Jr. | 131/175 |
| 5,388,595 | 2/1995 | Shafer | 131/175 |
| 5,396,907 | 3/1995 | Rojashenao et al. | 131/175 |

*Primary Examiner*—V. Millin
*Assistant Examiner*—Charles Anderson
*Attorney, Agent, or Firm*—Douglass F. Vincent

[57] ABSTRACT

A smoker's box for reducing pollution caused by smoking a cigarette. A housing has a first and second portion, the first portion defining a cavity, and the second portion defining a fan chamber. A venting channel allows gases to pass between the first and second housing portions. A lighter is provided to light a cigarette within the cavity. A mouthpiece and a cigarette sleeve for holding a cigarette define an inhalation channel open to the surrounding atmosphere. A replaceable cartridge includes a burn chamber in which the cigarette burns, a smoke treatment chamber adjacent to the burn chamber, a particulate filter between the burn chamber and the smoke treatment chamber, and smoke treatment means within the smoke treatment chamber for absorbing exhaled smoke passing within the smoke treatment chamber to produce a decontaminated gaseous mixture.

9 Claims, 2 Drawing Sheets

SMOKER'S BOX

TECHNICAL FIELD OF THE INVENTION

The present invention relates, generally, to a device used by smokers for reducing smoke pollution and, more specifically, to a device which allows a cigarette to be lighted and smoked, and the smoke therefrom filtered, entirely within a replaceable cartridge within the device.

BACKGROUND OF THE INVENTION

Health problems related to the inhalation by non-smokers of "passive smoke," or second-hand smoke, produced by smokers while they are lighting and smoking cigarettes, has been well documented and needs no further elucidation. The prior art is replete with devices that attempt to alleviate or eliminate second-hand smoke released into a surrounding atmosphere by smokers during smoking. One such device, disclosed in U.S. Pat. No. 4,807,646, utilizes a bladder to contain exhaled smoke and prevent such from escaping into the ambient atmosphere. While suitable for its intended purpose, the bladder is cumbersome and will build up in pressure making exhalation of cigarette smoke a difficult task. To drain the bladder of exhaled smoke, a manually controllable flap must be opened, resulting in unfiltered smoke escaping to the surrounding atmosphere. Furthermore, the device allows smoke to escape when the cigarette is first lighted.

Another device, disclosed in U.S. Pat. No. 4,790,332, filters exhaled smoke prior to releasing it to the atmosphere. While suitable for its intended purpose, the device has no means of creating the vacuum necessary to supply combustion air and pull the smoke from the lighted end through the filter. Furthermore, while using replaceable filters, the device offers no convenient way to maintain the inside of its body, which will eventually build up a tar residue from repeated use. Also, the user must utilize two mouthpieces alternately and tip the device between inhalation and exhalation, making its use cumbersome. Finally, the device does not prevent smoke from escaping when the cigarette is first lighted.

Other patents that disclose devices showing approaches to solving the above stated problem include U.S. Pat. Nos. 4,200,114, 4,066,088, 4,369,798 and 4,083,374.

A need exists for a device for use by smokers which reduces pollution released into the ambient air by smoking and which conveniently uses a single mouthpiece for easy use. It would be beneficial if the device were to allow the cigarette to be lighted and smoked entirely within the device, so that only a minimal amount of the resulting smoke passes out of the device without first being filtered. It would further be desirable if, in such a device, the smoke from the burning end of the cigarette were actively drawn through the device's filtration system and exhausted into ambient air. This would also draw in the necessary combustion air. It would further be desirable if the device provided an inexpensive and conveniently replaceable cartridge within which tar and ash from repeated use could be contained and easily disposed. Another advantage would be provided if the cartridge contained the device's filtration system so that the filtration system could simultaneously be conveniently and inexpensively replaced.

SUMMARY OF THE INVENTION

Against the foregoing background, a smoking apparatus is provided which offers convenient use to the smoker, is simple and inexpensive to maintain, and which allows the cigarette to be lighted in so that the smoke generated, both during the lighting of the cigarette and during smoking, does not pass to outside atmosphere without first being filtered. These advantages are accomplished by the use of a hand held housing having two openable housing portions. In a preferred embodiment of the present invention, a first housing portion defines a cavity within which a replaceable cartridge is insertable. An exhaust fan is provided within the second housing portion and vented to the surrounding atmosphere. Lighter means are also provided within the second housing portion and is extendable into the cavity.

The cartridge includes a burn chamber within which a cigarette may be lighted and smoked. The cartridge also includes an adjoining smoke treatment chamber containing a smoke treatment agent. A particulate filter is provided which separates the burn chamber from the smoke treatment chamber. A side of the cartridge adjacent to the smoke treatment chamber is vented. While the cigarette is being lighted and smoked, resulting smoke is passed from the burn chamber through the particulate filter into the treatment chamber and out through the cartridge vents into a venting channel in the first housing portion. The resulting decontaminated gaseous mixture is then fed to the exhaust fan via the venting channel and exhausted into the surrounding atmosphere.

The present invention further includes a mouthpiece assembly which is detachably mounted in sealing relationship to a front wall of the first housing portion. The assembly includes a cigarette sleeve integral with a mouthpiece. A cigarette may be loaded into the sleeve and placed inside of the burn chamber prior to being lighted by the lighter means. A first provided check valve allows for smoke to be inhaled into the smoker's lungs through the mouthpiece. A second provided check valve releases exhaled smoke into the burn chamber through a provided aperture in the front wall. The fan, activated as the cigarette begins burning, draws the smoke from the burn chamber through the particulate filter, into the treatment chamber, the housing channel, the exhaust fan chamber and out to the surrounding atmosphere.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

Figure 1:
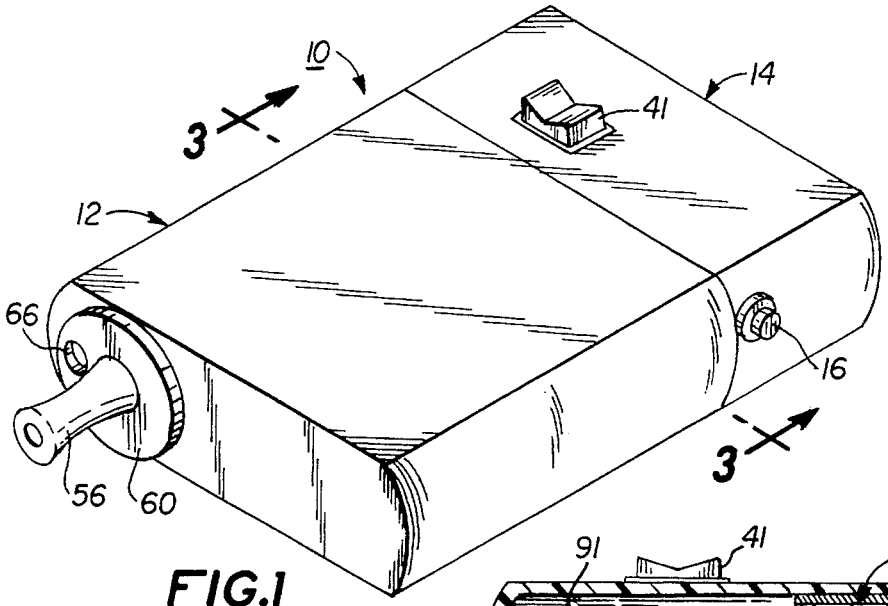
FIG. 1 is a perspective view illustrating a smoking apparatus of the present invention.
Figure 3:
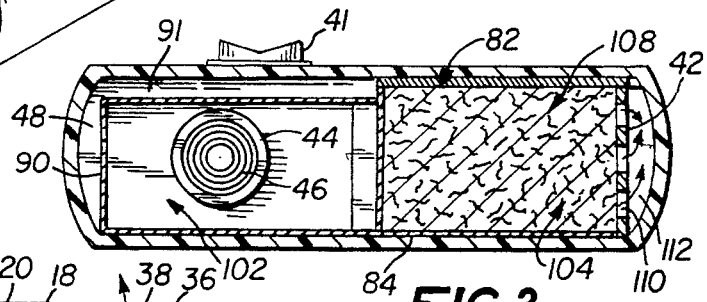
FIG. 3 is a vertical section view, taken along line 3—3 of FIG. 1, illustrating the interior of the replaceable cartridge.
Figure 2:
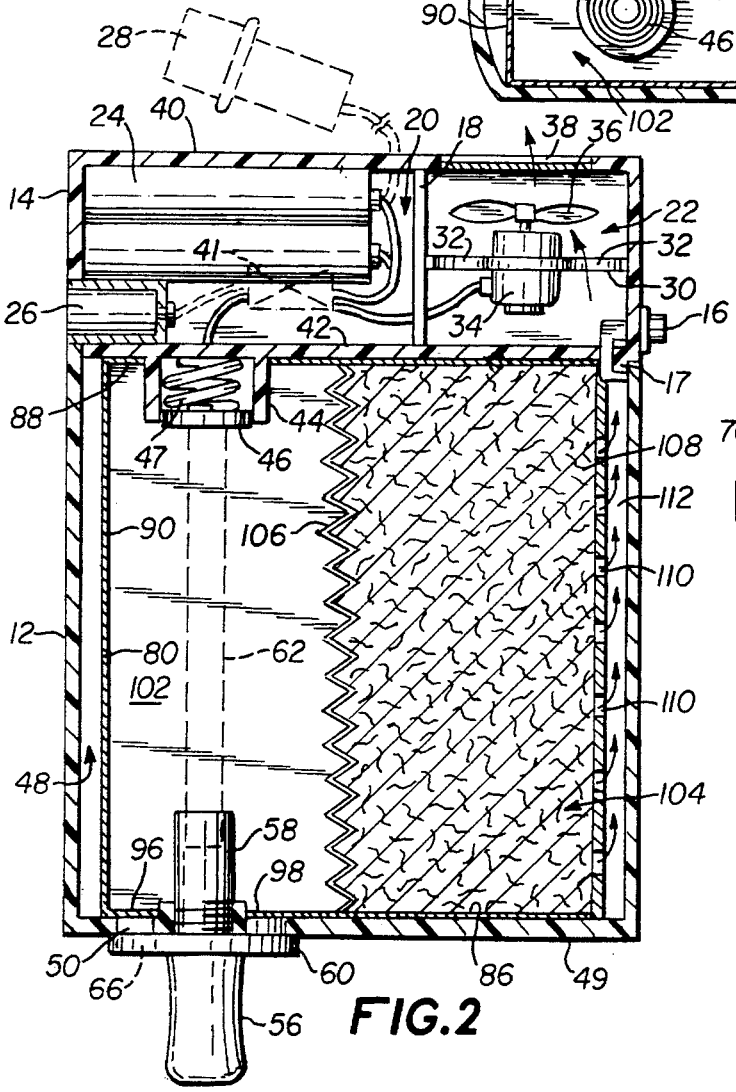
FIG. 2 is a plan view of the smoking apparatus with the entire top surface removed illustrating the interior of the apparatus.

FIGS. 1–3 illustrate a preferred smoking apparatus 10 of the present invention. The apparatus 10 comprises a housing which consists of a first housing portion 12 and a second housing portion 14. The two housing portions 12, 14 are releasably connected to one another via at least one conventional push button j-hook latch 16 which releasably engages a latch rod 17 fixedly attached to the first housing portion 12. An o-ring or gasket (not illustrated) may run along the perimeter of the housing portions 12, 14 between their adjoining edges to further seal the interface between the portions.

As best seen in FIG. 2, the second housing portion 14 is divided by an internal wall 18 into a power compartment 20 and a fan compartment 22. Inside of power compartment 20 is a power source 24, such as a 5 volt or greater rechargeable battery. It will be appreciated that any conventional power source may be utilized which provides adequate power to the electrical components of the smoking apparatus 10 as will be described herein. A recharge jack 26 is shown in FIG. 2 to be coupled to an independent power supply (not shown) to recharge the battery. Alternatively, in another embodiment of apparatus 10 the batteries may be substituted with a conventional car lighter power plug 28 which is shown in phantom lines in FIG. 2.

Within compartment 22 is another interior wall 30 subtending compartment 22 into two portions. Port apertures 32 in wall 30 allow the two subtended portions to be in gaseous communication with each other. An exhaust fan 34 is mounted to the wall 30 with its blades 36 facing an exhaust screen 38 in a back wall 40 of the second housing portion 14. A three way rocker switch 41 is mounted to the top of housing portion 14, and will be described herein.

An interior wall 42 extends laterally from one side of the housing portion 14 to the other. A cylindrical containing sleeve 44 extends from the wall 42 towards the front of the device. A lighter element, or means, 46 is frictionally contained within the sleeve 44. A spring, or urging means, 47 biases the lighter element 46 towards the front of apparatus 10. Preferably, lighter element 46 is comprised of an electric heating coil (best shown in FIG. 3) electrically coupled to the power source 24.

Figure 4:
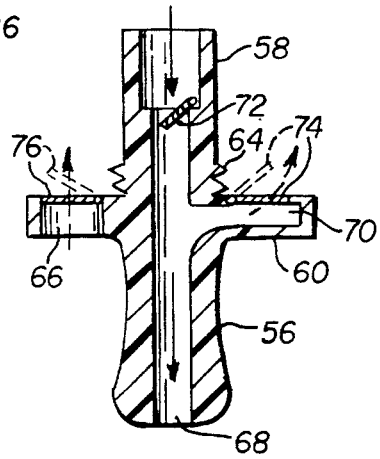
FIG. 4 is an enlarged plan view of the mountable mouthpiece assembly showing the valves and chambers within the assembly.
Figure 5:
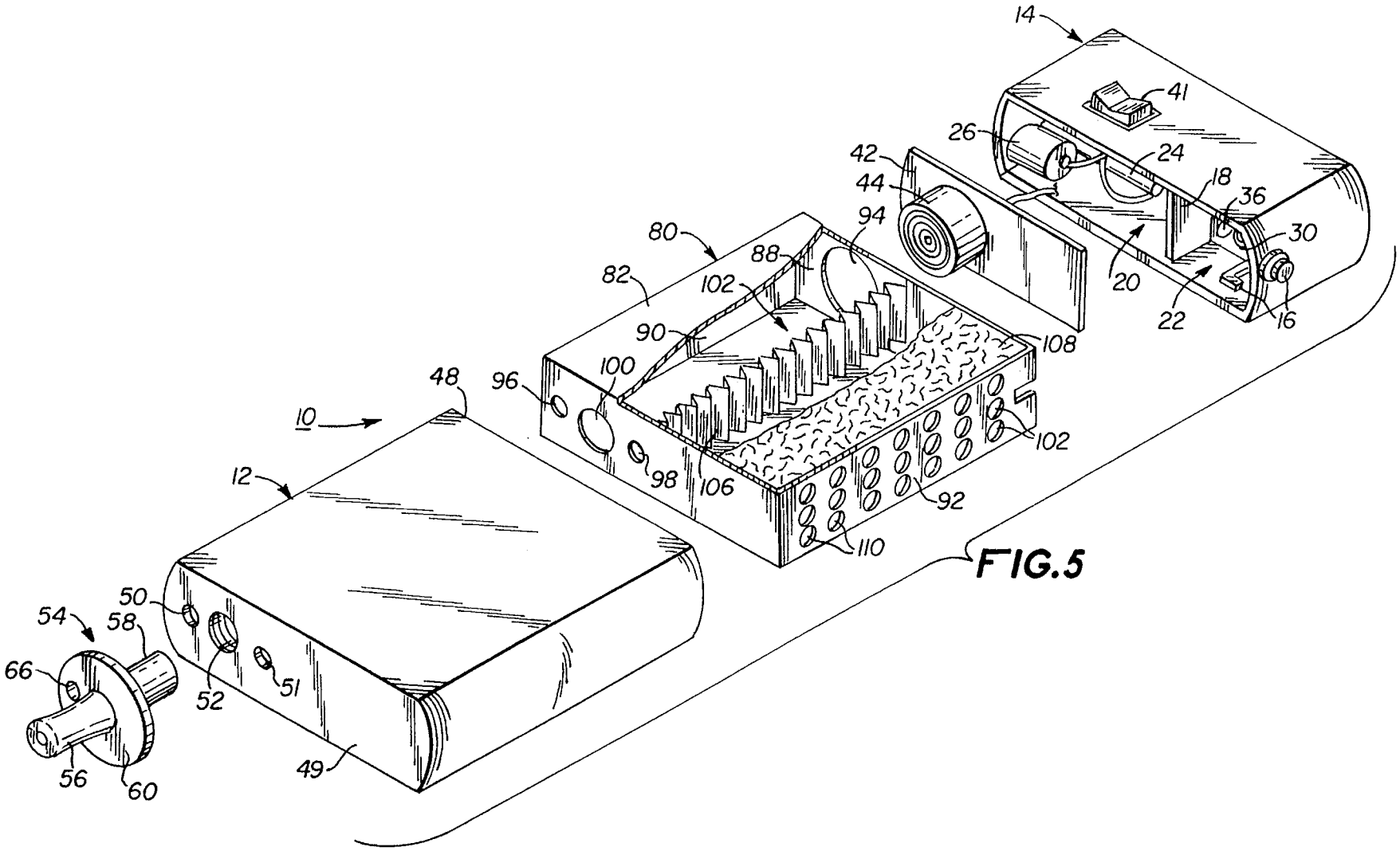
FIG. 5 is an exploded perspective view showing the mouthpiece assembly, the first housing portion, the replaceable cartridge, the front wall of the second housing portion, and the second housing portion.

A large cavity 48 is defined by the housing portion 12 and is gaseously separated from compartments 20, 22 by the interior wall 42. A front wall 49 of the housing portion 12 has two port apertures 50, 51 and a threaded aperture 52. A provided mouthpiece assembly 54 mounts to the front wall. The mouthpiece assembly includes a mouthpiece 56, a cigarette sleeve 58, and a loading cap 60. It is important to the utilization of apparatus 10 that the mouthpiece assembly be removable for the insertion of a cigarette 62 into the sleeve 58 so that it may be loaded into the cavity 102 to be lighted. This is accomplished by disengaging a threaded portion 64 of the sleeve 58 from its engaged position on the threaded aperture 52, loading a cigarette 62 into the sleeve 58, and reengaging the threaded portion 64 onto the threaded aperture 52 such that the loading cap 60 is in a generally sealed relationship against the front wall 49. As best seen in FIG. 4, the mouthpiece 56, the sleeve 58, and the loading cap 60 are integrally formed and define channels 68 and 70 in gaseous communication with each other. Channel 68 extends from the sleeve 58 through the mouthpiece 56. Channel 70 extends perpendicularly from channel 58 through loading cap 60 and terminates in gaseous communication with the port aperture 51. A first check valve 72 is provided within channel 68 and is biased to open when a smoker inhales on the mouthpiece 56 allowing cigarette smoke from the cigarette 62 (after it is lighted) to be drawn into the smoker's mouth and lungs. When the smoker exhales the smoke into mouthpiece 56, a second check valve 74, provided within channel 70, opens and passes the exhaled smoke through port aperture 51 into the cavity 102.

A third check valve 76 is provided within the loading cap aperture 66. Aperture 66 is aligned with port aperture 50 in front wall 49 when the mouthpiece assembly 54 is screwed into place. The check valve 76 is pressure-sensitive to the pressure differential created by the exhaust fan 34, when the fan is activated, and the sucking by the smoker on mouthpiece 56, allowing surrounding air outside of the apparatus 10 to enter within the cavity 48 to provide combustion air to burn the cigarette.

In accordance with an important aspect of the present invention, a replaceable cartridge, or enclosure 80 is provided for insertion into and removal from cavity 48 when housing portions 12 and 14 are opened and separated. The cartridge 80 has a top 82, a bottom 84, a front wall 86, a back wall 88 and sides 92, 90. The cartridge 80 is sized to fit within the cavity 48 substantially filling the cavity 48. Preferably, an air space 91 will be provided between the top 82 of the cartridge 80 and the housing 12, to alleviate heat transfer to the housing 12, making the unit more comfortable for a user to hold. Cartridge 80 is also kept in place by the corners of the housing 12 where the bowed sides meet the bottom of the housing. The bowed sides also form channels on either side of the cartridge. The cartridge is further kept in place by front wall 49 and the wall 42, and is actually mounted to those walls as will be described. The back wall 88 defines a lighter aperture 94 sized to snugly receive the containing sleeve 44 and the lighter 46. The front wall 86 of the cartridge 80 contains two port apertures 96, 98. Aperture 96 is located such that it is adjacent to port aperture 50 when the cartridge is in place. Aperture 98 correspondingly is adjacent to port aperture 51. A sleeve aperture 100 is also provided. The sleeve aperture 100 is sized slightly larger than the sleeve 58 so that the sleeve is readily insertable and removable therethrough. The cartridge defines an enclosed burn chamber 102 and an enclosed treatment chamber 104. A particulate filter, or means 106 separates the two chambers by extending from the top 82 to the bottom 84 of the cartridge 80. The particulate filter 104 is preferably a High Efficiency Particulate Air (HEPA) filter, well known in the art. The cartridge 80 may be made from a materials/food grade polycarbonate of the same type as the housing portions 12, 14 but is preferably made from a thick burn resistant cardboard paper. In this manner, the cartridge is inexpensive to manufacture and is also biodegradable for maximum disposability.

The burn chamber 102 is an empty chamber and provides the collection surfaces upon which tar and ashes can deposit. The utility of the burn chamber 102 is simply provided in that the cigarette is smoked entirely therewithin. The cigarette smoke passes from the burn chamber 102 through the filter 106 into the treatment chamber 104. The treatment chamber 104, contains a smoke treatment agent 108, which is preferably a blend of chemically treated activated charcoal granules. Smoke passing through the treatment chamber 104 ultimately passes vents 110 in the side wall 92 of the cartridge, into a channel 112 defined between the wall 92 and a bowed side of the housing. Channel 112 is in gaseous communication with compartment 22, so the resulting decontaminated gaseous mixture emerging from the treatment chamber is vented by the exhaust fan 34.

Having described the primary elements of the apparatus 10, its use is now described. A smoker unlatches the housing portions 12, 14 to open the housing of the apparatus and inserts a fresh cartridge 80 into the cavity 48. With the sleeve aperture 100 about the sleeve 58, the smoker then closes the housing containing walls 44 inserted through the aperture 94 to partially hold cartridge 80 in place. To smoke a cigarette, the user unscrews the mouthpiece assembly 54 from the front wall 49, and places the inhalation end of a cigarette into the sleeve 58. The smoker then rescrews the mouthpiece assembly 54 to the front wall 49, thus loading the cigarette into the burn chamber 102 of the cartridge 80. The smoker then pushes rocker switch 41 into a first position to activate the lighter element 46 and fan 34. The lighter element 46 and sleeve 58 are so spaced such that the ignition end of the cigarette abuts the lighter element 46 which is urged against the cigarette by spring 47. The smoker then inhales the cigarette through the mouthpiece 56. The rocker switch 41 springs from the first position automatically to a second position which only maintains power to the fan 34. When the smoker exhales through the mouthpiece 56, the exhaled smoke enters the burn chamber 102 through the second check valve 74 and is drawn through the HEPA filter 106, through the smoke treatment chamber 104, through the venting ports 110 into the fan chamber compartment 22 and out to ambient air through the exhaust screen 38. When the smoker is finished, he may turn the rocker switch to a third position, turning off the fan 34 so that nothing is on. After repeated use, the smoker may reopen the apparatus, remove the replaceable cartridge, and replace with a fresh cartridge 80.

As will be appreciated in this manner an apparatus 10 is provided which enables a cigarette to be lighted and smoked entirely within the apparatus 10 with no unfiltered smoke leaving the apparatus. It will further be appreciated that the apparatus provides for convenient smoking through a single mouthpiece assembly which uses a triple valve system to maintain combustion of the cigarette, to allow for smoke to be drawn from the cigarette for inhaling, and to allow smoke to be exhaled from the smoker back into a replaceable cartridge inside the apparatus. It will further be appreciated that the apparatus offers a unique replaceable single cartridge in which tar build-up and ashes can be contained, and disposed of therewith, and through which an included filtration system can be simultaneously replaced and which is inexpensive and biodegradable.

We claim:

1. A smoking apparatus for reducing pollution caused by smoking a cigarette having an igniting end and an inhaling end, said apparatus comprising:

a housing having a first and second housing portions, said first housing portion defining a cavity and having a top, a front wall, a first, a second and a third aperture in said front wall, and said second housing portion defining a fan chamber;

a venting channel in gaseous communication between said cavity and fan chamber;

a power source;

lighter means disposed extending from within said second housing portion into said cavity and coupled to said power source for lighting a cigarette within said cavity;

electric fan means disposed within said fan chamber and coupled to said power source for exhausting a gaseous mixture to an atmosphere outside of said housing;

a mouthpiece assembly releasably mountable to said first housing portion wall including:

a mouthpiece extending outwardly from said first housing portion front wall;

a cigarette sleeve for mounting the inhalation end of a cigarette therein, with the cigarette being disposed generally along its longitudinal dimension within said cavity, said cigarette sleeve extending through said first aperture into said cavity, said cigarette sleeve and said mouthpiece defining an inhalation channel open to the surrounding atmosphere;

a first check valve means disposed in a gas-tight relationship within said inhalation channel, said first valve means for opening by sucking action on said mouthpiece to allow smoke to be drawn into said inhalation channel;

fastening means for releasably securing said mouthpiece to said housing;

an exhalation channel in gaseous communication with said inhalation channel and said cavity;

a second check valve means disposed in a gas-tight relationship within said exhalation channel for opening by blowing action on the mouthpiece to release exhaled gas into said cavity through said second aperture;

a third check valve means for opening to intake atmospheric air from the surrounding atmosphere into said cavity through said third aperture;

a replaceable cartridge, removably disposable within said cavity, said cartridge having a top, a bottom and a side, and comprising:

a burn chamber including a front wall and a rear wall, said front wall defining an aperture through which said cigarette sleeve may be disposed, said rear wall defining an aperture through which said lighter means may be disposed;

a smoke treatment chamber adjacent to said burn chamber;

particulate filter means extending from said top to said bottom of said cartridge and disposed between and separating said burn chamber and said smoke treatment chamber, said filter means for filtering particulates in exhaled cigarette smoke passing therethrough;

smoke treatment means disposed within said smoke treatment chamber for absorbing exhaled smoke passing within said smoke treatment chamber to produce a resulting decontaminated gaseous mixture;

switch means for activating said lighter means;

switch means for activating said exhaust fan; and wherein said cigarette sleeve and said lighter means are spaced from one another so that when the inhaled end of the cigarette is inserted into said sleeve, said lighter means abuts the igniting end of the cigarette.

2. A smoking apparatus as claimed in claim 1, wherein:

said housing is generally comprised of a hardened plastic; and said replaceable cartridge is generally comprised of a hardened plastic.

3. A smoking apparatus, as claimed in claim 1, wherein:

said replaceable cartridge is fabricated from a paper product.

4. A smoking apparatus, as claimed in claim 1, wherein:

said replaceable cartridge has a height less than the height of said housing, so that a cooling space is defined between the top of said cartridge and said housing.

5. A smoking apparatus, as claimed in claim 1, further comprising:

means for urging said electric lighting means against the igniting end of a cigarette.

6. A smoking apparatus, as claimed in claim 1, wherein:

said lighter means includes an electrical heating coil.

7. A smoking apparatus, as claimed in claim 1, wherein:

said particulate filtering means fabricated from a paper product.

8. A smoking apparatus, as claimed in claim 1, wherein:

said smoke treatment means includes chemically treated activated charcoal granules.

9. A replaceable cartridge having a top, a bottom and a side wall for inserting into a smoking apparatus housing, said smoking apparatus including a housing, lighter means disposed within said housing, and a cigarette sleeve disposed within said housing, said replaceable cartridge comprising:

a burn chamber having a front wall and a rear wall, a first aperture in said front wall through which a cigarette loaded in the cigarette sleeve may be inserted for burning in said burn chamber, and a second aperture in said rear wall through which said lighter means may be inserted;

a smoke treatment chamber adjacent to said burn chamber;

smoke treatment means disposed within said smoke treatment chamber for absorbing cigarette smoke passing within said smoke treatment chamber to produce a resulting decontaminated gaseous mixture;

particulate filter means interposed between said smoke treatment chamber and said burn chamber separating said two chambers and extending from the top to the bottom of said cartridge; and venting ports in the side of said cartridge for venting the decontaminated gaseous mixture from said smoke treatment chamber into the smoking apparatus housing.

* * * * *